United States Patent [19]

Lee

[11] Patent Number: 4,764,652

[45] Date of Patent: Aug. 16, 1988

[54] POWER CONTROL DEVICE FOR HIGH-FREQUENCY INDUCED HEATING COOKER

[75] Inventor: Min K. Lee, Changwon, Rep. of Korea

[73] Assignee: Gold Star Co., Ltd., Seoul, Rep. of Korea

[21] Appl. No.: 41,351

[22] Filed: Apr. 22, 1987

[30] Foreign Application Priority Data

Apr. 23, 1986 [KR] Rep. of Korea ..... 5557/1986

[51] Int. Cl.[4] ..... H05B 6/06

[52] U.S. Cl. ..... 219/10.77; 219/10.493; 363/97

[58] Field of Search ..... 219/10.77, 10.75, 10.49 R; 363/97, 21, 131

[56] References Cited

U.S. PATENT DOCUMENTS

| | | | |
|---|---|---|---|
| 4,356,371 | 10/1982 | Kiuchi et al. | 219/10.77 |
| 4,447,691 | 5/1984 | Mizukawa et al. | 219/10.49 R |
| 4,467,165 | 8/1984 | Kiuchi et al. | 219/10.77 |
| 4,540,866 | 9/1985 | Okuda | 219/10.77 |
| 4,599,504 | 7/1986 | Ito | 219/10.77 |

*Primary Examiner*—Philip H. Leung

*Attorney, Agent, or Firm*—Birch, Stewart, Kolasch & Birch

[57] ABSTRACT

A power control device for high-frequency induced heating cooker is designed to supply a constant power to the work coil regardless of any change in the input current and voltage. The control device compares the voltage detected at the input current sensor detecting the input current of the full-wave rectifier with the set voltage of the user selector and applies a control voltage to the pulse oscillator and applies the pulse oscillating signal of the pulse oscillator to the driver and makes the switching transistor rapidly turn on and off to generate a high-frequency current through the work coil. It includes a voltage sensor to detect the input and output voltages of the coil, a comparator to compare both detector voltages and to determine the drive starting point of the oscillator, a subtractor to subtract the voltage on the input side of the work coil from the set voltage of the user selector, a comparator to compare the voltage detected at the input current sensor with the normal vessel reference voltage, a transistor to cut off the control voltage applied to the pulse oscillator, a search control voltage part to produce a search control voltage of a constant level and a starting circuit part to generate an oscillation signal of a constant cycle, and a transistor turned on and off by the oscillation signal and supplies the search control voltage to the pulse oscillator in a constant period.

4 Claims, 3 Drawing Sheets

POWER CONTROL DEVICE FOR HIGH-FREQUENCY INDUCED HEATING COOKER

FIELD OF INVENTION

The invention relates to a power control device for the high-frequency induced heating cooker, particularly a current control device designed to supply a constant electric power to a work coil of the high-frequency induced heating cooker regardless of any change in the input current and voltage.

The high-frequency induced heating cooker is destined to make an eddy current of high-frequency to flow through a vessel of magnetic substance by generating a magnetic force of high-frequency in the work coil and applying it to the vessel of magnetic substance, and to produce thereby the heat by the surface resistance of the vessel so that the materials to be cooked in the vessel are heated.

DESCRIPTION OF THE PRIOR ART

According to the conventional high-frequency induced heating cooker, it is designed to detect the input current in voltage, to compare it with the level set by the user, and to control the drive of a pulse oscillator according to the result of comparison so as to make a constant current flow through the work coil. Consequently, it is impossible to maintain constant the electric power supplied to the work coil. In other words, since the electric power supplied to the work coil is produced by a multiplication of the current and the voltage, any change in the input voltage leads to a change in the supply power so that it is impossible to maintain it constant, and if the input voltage is changed drastically, then the electric power supplied to the work coil is accordingly, changed drastically to reduce the stability of products.

As shown in FIG. 3, which is a circuit diagram of the conventional high-frequency induced heating cooker, the input AC power source 51 is subject to a full-wave rectification in the full-wave rectifier 52, and after passing through the noise and impulse voltage absorption condenser C1 and choke coil L1, the input is smoothed in the smoothing condenser C2, and then it is applied to the resonance circuit of the work coil L2 and condenser C3, while as the switching transistor Q1 is switched on or off rapidly, the high-frequency current flows. On the other hand, the current put in the full-wave rectifier 52 is detected in voltage at the input current sensor 53, and the detected voltage is compared at comparator 55 with the set voltage of the user selector 54 to control the drive of pulse oscillator 56. That is to say, if the detected voltage is lower than the set voltage, then the pulse oscillator 56 is driven to generate the pulse signal of high-frequency which is applied to the base of switching transistor Q1 through the driver 57 to turn it on or off so that the high-frequency current flows to the work coil L2. While if the detected voltage of the input current sensor 53 is higher than the set voltage of the user selector 54, then the drive of the pulse oscillator 56 is stopped, the switching transistor Q1 is maintained in the off-state, and thereby a constant current corresponding to the set voltage of the user selector 54 flows to the work coil L2.

As described above, the conventional device has a disadvantage in that since it is controlled in such a way that only the input current is detected and a constant current flows thereby to the work coil L2, the electric power supplied to the work coil L2 cannot be changed as the input voltage is changed, which results in the lowering of stability of the products.

SUMMARY OF THE INVENTION

It is the object of the invention to provide a power control device for the high-frequency induced heating cooker designed to supply a constant electric power to the work coil even though the input current and voltage are changed.

It is another object of the invention to provide a power control device for the high-frequency induced heating cooker designed to prevent the current from flowing to the work coil by making the switching transistor off whenever a normal vessel is not placed on the work coil, or the temperature of the surroundings in which the vessel is placed, has risen over a determined temperature.

These objects of the invention are, according to the invention, attained in such a way that in order to make a high-frequency current flow to the work coil by comparing the voltage detected at the input current sensor with the set voltage of the user selector, applying the control voltage to the pulse oscillator, applying the pulse oscillating signal of the pulse oscillator to the driver, and rapidly turning on and off the switching transistor. One detects the voltage put in the input side of the said work coil and subtracts the detected voltage from the set voltage of the said user selector, compares the magnitude of the input and output voltages of the said work coil and determines the drive starting point of the said pulse oscillator. If the voltage detected at the said input current sensor is lower than the reference voltage used in the normal vessel, then one cuts off the control voltage applied to the said pulse oscillator and at the same time supplies and cuts off at a regular period a new search control voltage to the said pulse oscillator, and when the temperature of the surroundings in which the vessel of magnetic substance is placed, has risen over a determined temperature, one cuts of the control voltage supplied to the said pulse oscillator.

BRIEF DESCRIPTION OF THE DRAWINGS

In the accompanying drawings.

DETAILED DESCRIPTION OF THE PREFERRED EMBODIMENTS

Composition and operational effects of the invention will now be described in more detail with reference to the accompanying drawings.

Figure 1:
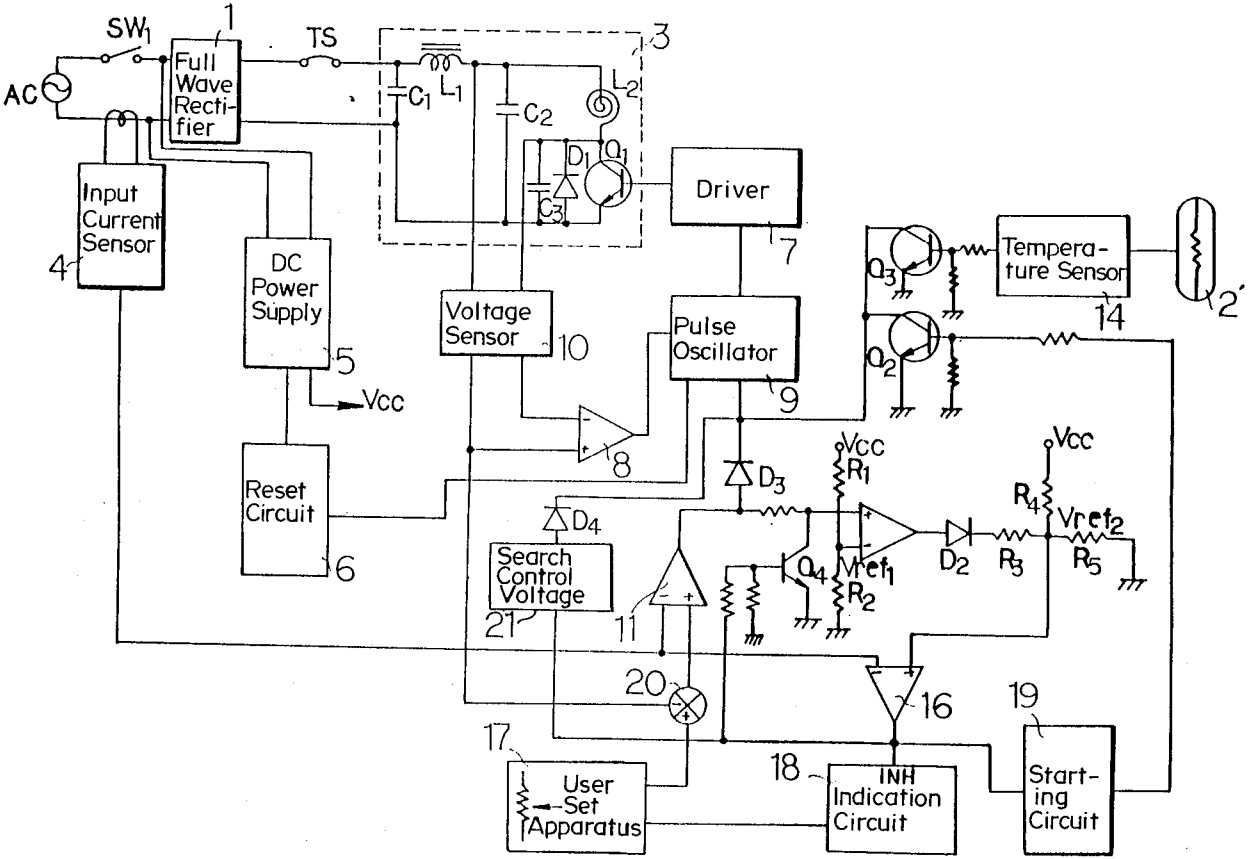
FIG. 1 is a circuit diagram of the power control device according to the invention.

As shown in FIG. 1, which is a circuit diagram of the power control device according to the invention, the high-frequency induced heating cooker destined to rectify AC power source at the full-wave rectifier 1 and supply it to the smoothing condenser C2 and the work coil L2 through the noise and impulse voltage absorption condenser C1 and the choke coil L1 of the inverter part 3. Also, the cooker will detect in voltage the current put in the said full-wave rectifier 1 at the input current sensor 4, and compare the detected voltage with the set voltage of the user set apparatus 17 at the comparator 11 to apply a control voltage to the pulse oscillator 9, and to apply a pulse oscillating signal of the pulse oscillator 9 to the driver 7 and to turn on and off the switching transistor Q1 of the said inverter part 3, so that a high-frequency current flows to the said work coil L2. The circuit comprises a voltage sensor 10 for detecting the voltages on the input side and output side of the said work coil L2, a comparator 8 for determing the drive starting point of the pulse oscillator 9 by comparison of both the detected voltages of the voltage sensor 10, and the subtractor 20 subtracts the voltage on the input side of the work coil L2, which is sensed at the voltage sensor 10, from the set voltage of the user selector 17. Further, a comparator 13 to compare the control voltage put out of the comparator 11 with the vessel removal reference voltage V ref 1 and applies it to the side of normal vessel reference voltage V ref 2, and a comparator 16 compares the detected voltage of the input current sensor 4 and the normal vessel reference voltage V ref 2. Also, a transistor Q4 makes the output control voltage of the comparator 11 flow to the earth by the high-potential output signal of the comparator 16, and a search control voltage part 21 produces the search control voltage and supplies it to the pulse oscillator 9 and a starting circuit part 19 to produce the oscillating signal of constant cycle. Next, a transistor Q2 will cut off and supply the control voltage applied to the pulse oscillator 9 by switching on and off through the oscillating signal of the starting circuit part 19, and a temperature sensing circuit part 14 will sense that the temperature of surroundings in which the vessel is placed, has risen over the determined temperature, and a transistor Q3 will cut off the control voltage switched on by the output signal of the temperature sensing circuit part 14 and apply to the pulse oscillator 9. The undescribed reference number 5 in the description of drawings represents a power supply circuit to put out the constant DC voltage Vcc from AC power source, the reference number 6 represents the reset circuit which applies the driving voltage to the pulse oscillator 9 when the output voltage of the power supply circuit 5 is maintained at a higher level than the constant voltage, the reference number 18 represents the indication circuit which indicates the set voltage state of the user selector 17 when the low potential signal is put out of the comparator 16, and TS represents the thermostat.

Figure 2:
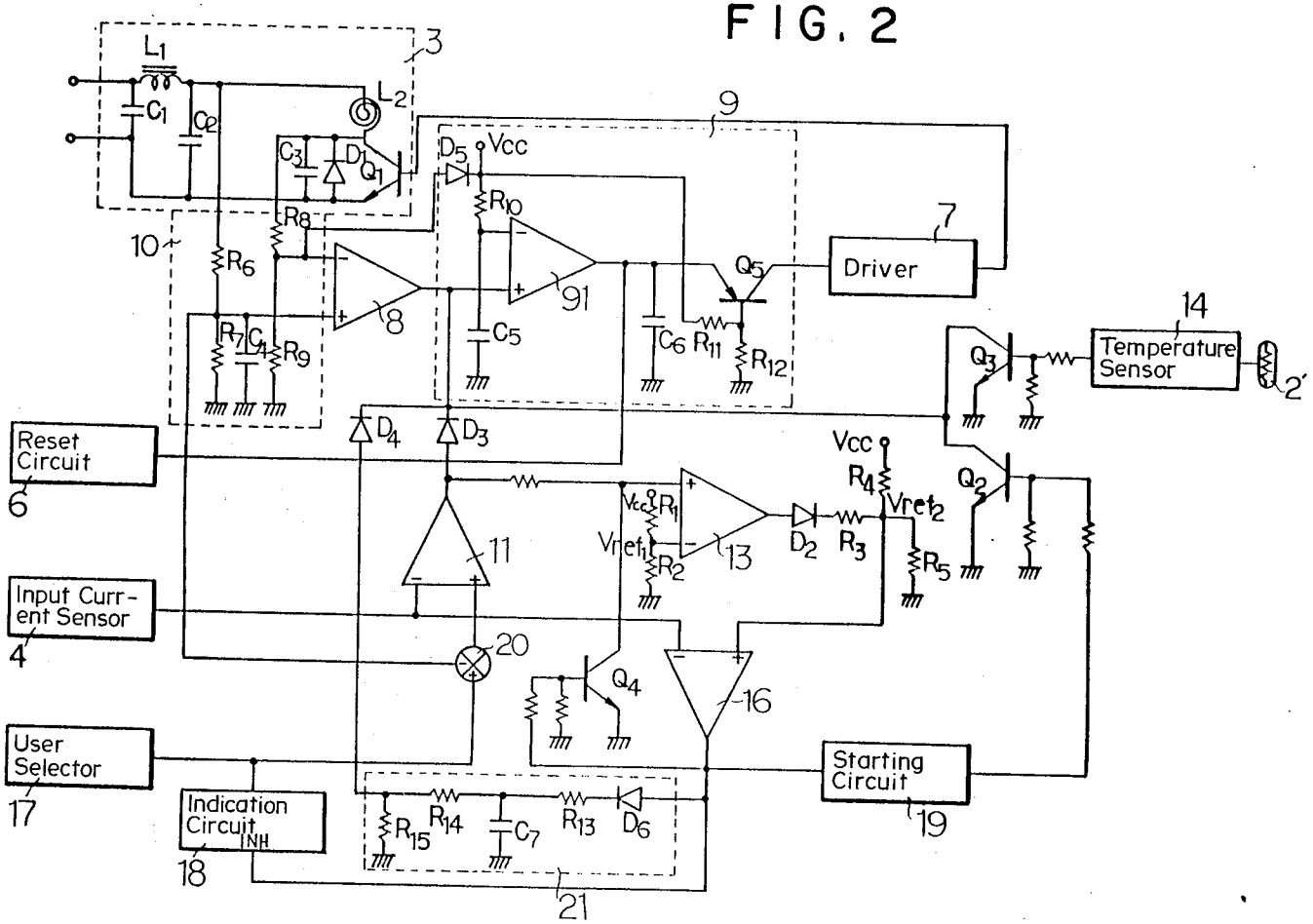
FIG. 2 is a detailed circuit diagram of an embodiment shown in FIG. 1.
Figure 3:
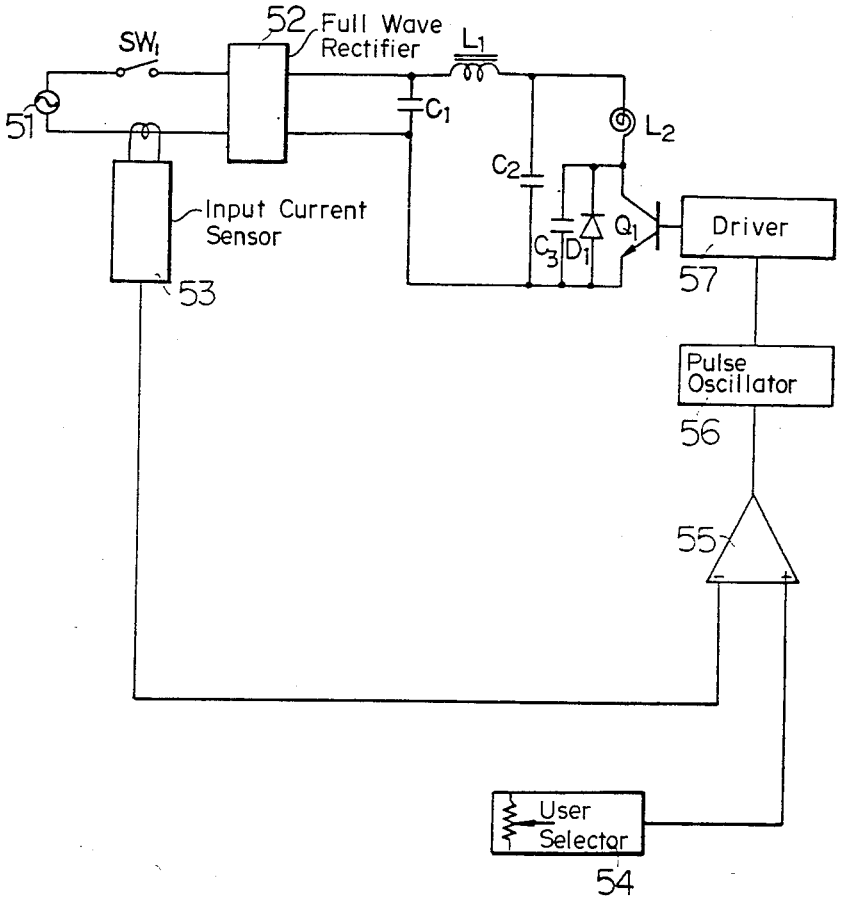
PRIOR ART FIG. 3
FIG. 3 is a circuit diagram of the conventional high-frequency induced heating cooker.

As shown in FIG. 2, which is a detailed circuit diagram of an embodiment shown in FIG. 1, the voltage sensor 10 comprises resistors R6–R9 and condenser C4 and detects the voltages on the input side and the output side of the work coil L2 of the inverter part 3, respectively. Both detected voltages are connected so as to be applied to the nonreversible and the reversible input terminals of the comparator 8, and the output side of the comparator 8 is connected to the input side of the pulse oscillator 9 comprising resistors R10–R12, condensers C5, C6, comparator 91 and transistor Q5.

The voltage on the input side of the work coil L2, which is detected at the said voltage sensor 10, is also connected so as to be applied to the minus input terminal of the subtractor 20 and to be subtracted from the set voltage of the user selector 17. The search control voltage part 21 comprises a diode D6, resistors R13–R15 and a condenser C7 so as to put out a search control voltage of a constant level at the time that a high-potential signal is put out of the comparator 16, and the search control voltage is connected so as to be applied to the nonreversible input terminal of the comparator 91 on the input side of the pulse oscillator 9 through the diode D4.

The operational effects of the invention comprised as described above will now be described in more detail.

When the main power supply switch (SW1) is short-circuited, the AC power source is rectified at the full-wave rectifier 1 and then supplied to the work coil L2 of the inverter part 3 through the thermostat TS. The AC power source is supplied to the power supply circuit 5, on the output side of which a constant DC voltage Vcc is put out. When the output voltage of the power supply circuit 5 becomes higher than the set voltage of the reset circuit 6, a constant voltage is put out of the reset circuit 6 and supplied to the output side of comparator 91 of the pulse oscillator 9 and the emitter contact of the transistor Q5.

Consequently, as described later, the pulse oscillator 9 is driven to put out the pulse signal, and this pulse oscillating signal makes the switching transistor Q1 switch on and off rapidly through the drive 7 and the high-frequency current flows thereby to the work coil L2. At this time, the current put in the full-wave rectifier 1 is detected in voltage at the input current sensor 4 and applied to the reversible input terminal of the comparator 11, and the set voltage of the user selector 17 is applied to the nonreversible input terminal of the comparator 11 through subtractor 20 so that the voltage that is proportional to the difference between the voltages put in both input terminals is put out as a control voltage which is applied to the nonreversible input terminal of the comparator 91 on the input side of the pulse oscillator 9 through the diode D3. However, this comparator 91 operates as an open collector. That is, in a case where the control voltage applied to the nonreversible input terminal of the comparator 91 is higher than the voltage applied to its reversible input terminal, its output terminal becomes an open state so that the voltage put out of the reset circuit 6 is charged in the condenser C6 and a high-potential signal is put out to the collector of the transistor Q5. In an opposite case, a low-potential signal is put out to the output terminal of the comparator 91 and the charged voltage of the condenser C6 is discharged so that a low-potential signal is put out to the collector of the transistor Q5.

The time of the high- and low-potential states of the pulse oscillating signal put out of the pulse oscillator 9 is proportional to the level of the control voltage put out of the comparator 11, and the pulse oscillating signal put out of the pulse oscillator 9 controls the on and off of the switching transistor Q1 through the driver 7 so that a constant current flows to the work coil.

On the other hand, since the voltages on the input and output sides of the work coil L2 are detected at the voltage sensor 10 and then applied to the nonreversible and reversible input terminals of the comparator 8, the switching transistor Q1 is off. When when the counter electromotive force is produced from the work coil L2, the voltage applied to the reversible input terminal of the comparator 8 becomes higher than the voltage applied to its nonreversible input terminal so that a low-potential signal is put out to its output side. When the voltage on the input side of the work coil L2 becomes lower than the voltage on its output side, the output terminal of the comparator 8 turns to an open state so that the drive starting point of the pulse oscillator 9 is determined. In other words, when the voltage on the input side of the work coil L2 becomes higher than the voltage on its output side, and the output terminal of the comparator 8 turns to an open state, the pulse oscillator 9 is driven by the control voltage of the comparator 11 to turn on the switching transistor Q1.

Furthermore, since the voltage on the input side of the work coil L2, which is detected at the voltage sensor 10, is applied to the minus input terminal of the subtractor 20 and subtracted from the set voltage of the user selector 17, the set voltage applied to the nonreversible input terminal of the comparator 11 is decreased in proportion to the increase of the voltage on the input side of the work coil L2. Finally, as the voltage on the input side of the work coil L2 rises, the on-time of the switching transistor Q1 becomes short and its off-time gets long.

Thus, the on and off time of the switching transistor Q1 is controlled by detecting the input current of the full-wave rectifier 1 and the input voltage of the work coil L2, and thereby a constant power is always supplied to the work coil L2.

On the other hand, in a case where a normal vessel of magnetic substance is not placed on the work coil L2, the current flowing through the work coil L2 is reduced and the voltage detected at the input current sensor 4 is lowered, so that the level of the control voltage put out of the comparator 11 relatively rises.

However, at this time, the voltage detected at the input current sensor 4 becomes lower than the normal vessel reference voltage V ref 2 set by the value of resistors R4, R5, the high-potential signal is put out to the output terminal of the comparator 16 to turn on the transistor Q4, and the control voltage of the comparator 11 flows thereby to the earth and the supply to the pulse oscillator is cut off. Since the high-potential signal put out of the comparator 16 is charged to the condenser C7 through the diode D6 and the resistance R13 of the search control voltage part 21, a search control voltage of constant level is put out of the search control voltage part 21, and this search control voltage is supplied to the input side of the pulse oscillator 9 through the diode D4. At this time, the starting circuit part 19 is driven by the high-potential signal put out of the comparator 16 and an oscillation signal of constant cycle is put out. As the transistor Q2 is turned on and off in a constant period by the oscillation signal of the starting circuit part 19, the said search control voltage is supplied to the pulse oscillator 9 in a constant period to drive it in a constant period. Consequently, the switching transistor Q1 is turned on and off in a constant period, and detects whether or not the vessel of magnetic substance is placed on the work coil L2.

In a state that a high-potential signal is put out of the comparator 16, the indication circuit 18 is not driven, and the set voltage level of the user selector 17 is not indicated on the indication circuit.

On the other hand, when the vessel of magnetic substance is removed slowly to a state that the normal vessel of magnegic substance is placed on the work coil L2 and is driven as described above, the current flowing through the work coil L2 is reduced gradually, and the voltage detected at the input current sensor 4 is lowered slowly so that the level of the control voltage put out of the comparator 11 is increased gradually. When the level of this control voltage exceeds the vessel removal reference voltage V ref 1 set by the value of the resistors R1, R2, a high-potential signal is put out to the output terminal of the comparator 13, and this high-potential signal is applied to the nonreversible input terminal of the comparator 16 together with the normal vessel reference voltage V ref 2 through the diode D2 and the resistance R3 so that the voltage applied to the non-reversible input terminal becomes higher than the voltage detected at the input current sensor 4 and a high-potential signal is put out of the comparator 16. As described above, accordingly, the high-potential signal is cut off and the control voltage of the comparator 11 is supplied to the pulse oscillator 9, and at the same time the search control voltage of a constant level is supplied to the pulse oscillator 9 in a constant period to drive the pulse oscillator 9 in a constant period.

When the ambient temperature in which the vessel of magnetic substance is placed, has risen over a determined temperature, it is detected at the temperature sensing part 14 and the transistor Q3 is thereby turned on so that the control voltage is not driven. Since the switching transistor Q1 is kept in an off-state and no current flows to the work coil L2, it is possible to prevent the ambient temperature in which the vessel of magnetic substance is placed, from rising beyond the determined temperature.

Whereas, the thermostat TS, which is mounted on the radiating plate of the switching transistor Q1, is open when the temperature of the radiating plate has risen beyond a determined temperature, to cut off the electric power supplied to the inverter 3.

As described above in detail, it is possible according to the invention to uniformly maintain the output of the work coil regardless of any change in the input voltage by detecting the input current of the full-wave rectifier and the input voltage of the work coil and supplying a constant power corresponding to the level of user set voltage to the work coil, to prevent the current from flowing through the work coil when the ambient temperature in which the vessel of magnetic substance is placed, or the temperature of the radiating plate of the switching transistor has risen beyond a determined temperature, and to always operate the apparatus in a stable area in order to further uniformly control the cooking time by detecting whether or not a normal vessel of magnetic substance is used, and controlling the on and off switching of the transistor.

What is claimed, is:

1. A power control device for a high-frequency induced heating cooker having a work coil driven by inverter means comprising:

rectifier means for rectifying AC power supplied to the inverter means;

input current sensor means for detecting the input current from the AC power supplied to said rectifier means;

first comparator means for comparing the detected input current of the input current sensor means with a manually selectable reference voltage;

pulse oscillator means for generating a rectangular pulse signal;

driver means for applying the rectangular pulse signal to said inverter means to turn said inverter means ON to thereby apply a high frequency current through said work coil;

voltage sensor means for detecting the voltages on both the input and output sides of the work coil;

second comparator means for comparing both detected voltages of the voltage sensor means and determining whether the output of said first comparator means will drive said pulse oscillator means;

means for substracting the voltage detected at the voltage sensor means on the input side of the work coil from the manually selected reference voltage;

third comparator means for comparing the detected voltage of the input current sensor means with a reference voltage which would be generated by the presence of a normal sized cooking vessel on the work coil;

semiconductor switch means for cutting OFF a high potential output signal of the third comparator means;

search control voltage means for generating an oscillating signal during a predetermined period;

starting circuit means for generating an oscillating signal during the predetermined period; and transistor means turned ON and OFF by the oscillating signal of the starting circuit means for cutting OFF the supply of the search control voltage to said pulse oscillator means at a predetermined time.

2. A power control device for a high-frequency induced heating cooker as claimed in claim 1, further including temperature sensing circuit means for detecting the ambient temperature of the cooking vessel connected to the transistor means for cutting OFF the supply of the search control voltage.

3. A power control device for a high-frequency induced heating cooker as claimed in claim 1, further including fourth comparator means for comparing the output of said first comparator means with a predetermined reference voltage, said fourth comparator means generating a high-potential signal when the removal of a normal cooking vessel is detected by the output of said first comparator means exceeding an additional reference voltage.

4. A power control device for a high-frequency induced heating cooker as claimed in claim 1, further including indication circuit means for indicating a low-potential output signal from the third comparator means.

* * * * *